US008282873B2

(12) United States Patent
Barinov et al.

(10) Patent No.: US 8,282,873 B2
(45) Date of Patent: Oct. 9, 2012

(54) CONTROLLED ELECTROSPINNING OF FIBERS

(76) Inventors: Victor Barinov, Brooklyn, NY (US); Kalle Levon, Brooklyn, NY (US)

( * ) Notice: Subject to any disclaimer, the term of this patent is extended or adjusted under 35 U.S.C. 154(b) by 672 days.

(21) Appl. No.: 12/160,101

(22) PCT Filed: Jan. 3, 2007

(86) PCT No.: PCT/US2007/060067

§ 371 (c)(1),
(2), (4) Date: Oct. 7, 2008

(87) PCT Pub. No.: WO2007/079488

PCT Pub. Date: Jul. 12, 2007

(65) Prior Publication Data

US 2009/0152773 A1 Jun. 18, 2009

(51) Int. Cl.
*D01D 5/08* (2006.01)

(52) U.S. Cl. ..... 264/484; 264/172.17; 264/623; 264/638; 264/405; 264/433; 264/465; 264/467

(58) Field of Classification Search ..... 264/10, 264/433, 465, 467, 484, 172.16, 172.17, 264/623, 634, 638, 405; 425/3, 72.2, 378.2, 425/131.5, 174

See application file for complete search history.

(56) References Cited

U.S. PATENT DOCUMENTS 2,158,415 A * 5/1939 Formhals ..... 264/10
2,158,416 A * 5/1939 Formhals ..... 264/10
3,671,814 A * 6/1972 Heinrich ..... 361/154
3,860,369 A 1/1975 Brethauer et al.
4,233,014 A 11/1980 Kinney
4,689,186 A 8/1987 Bornat
4,965,110 A 10/1990 Berry
5,296,172 A 3/1994 Davis et al.
5,744,090 A * 4/1998 Jones et al. ..... 264/427
5,817,272 A 10/1998 Frey et al.
5,911,930 A 6/1999 Kinlen et al.
6,110,590 A 8/2000 Zarkoob et al.
6,265,466 B1 7/2001 Glatkowski et al.
6,444,151 B1 9/2002 Nguyen et al.
6,520,425 B1 2/2003 Reneker (Continued)

FOREIGN PATENT DOCUMENTS

JP 62057906 A * 3/1987

OTHER PUBLICATIONS

Theron et al, Electrostatic field-assisted alignment of electrospun nanofibres, 2001, Nanotechnology, 12, 384-390.*

(Continued)

*Primary Examiner* — Joseph Del Sole
*Assistant Examiner* — Timothy Kennedy

(57) ABSTRACT

Methods for controlled electrospinning of polymer fibers are described. The methods include spinning a polymer fiber from a fluid comprising a polymer in the presence of an electric field established between a plurality of collectors and a jet supply device controlling the dispersion characteristics of the fluid by applying a magnetic field created by at least one magnet located after the point of jet formation. Different voltages are applied to at least two collectors of the plurality of collectors. At least one magnet, located between the jet supply device and at least one collector, creates a magnetic field substantially transverse or substantially collinear to an electrospinning jet stream. The magnetic field changes direction of travel of the electrospinning jet stream.

22 Claims, 9 Drawing Sheets

U.S. PATENT DOCUMENTS

| | | | |
|---|---|---|---|
| 6,616,435 | B2 | 9/2003 | Lee et al. |
| 6,641,773 | B2 | 11/2003 | Kleinmeyer et al. |
| 6,656,394 | B2 | 12/2003 | Kelly |
| 6,695,992 | B2 | 2/2004 | Reneker |
| 6,713,011 | B2 | 3/2004 | Chu et al. |
| 6,753,454 | B1 | 6/2004 | Mello et al. |
| 6,858,168 | B1 | 2/2005 | Vollrath et al. |
| 6,955,775 | B2 | 10/2005 | Chung et al. |
| 6,989,125 | B2 | 1/2006 | Boney et al. |
| 6,991,702 | B2 | 1/2006 | Kim |
| 7,070,640 | B2 | 7/2006 | Chung et al. |
| 7,070,723 | B2 | 7/2006 | Ruitenberg et al. |
| 7,105,058 | B1 | 9/2006 | Sinyagin |
| 7,105,124 | B2 | 9/2006 | Choi |
| 7,105,812 | B2 | 9/2006 | Zhao et al. |

OTHER PUBLICATIONS

Yarin et al, Upward needleless electrospinning of multiple nanofibers, Polymer, 45, 2977-2980.*

JPO English Abstract for JP 62057906, 1987.*

English translation of JP 62057906, 2012.*

Reneker, D. H., Yarin, A. L., Fong, H., and Koombhongse, S., "Bending instability of electrically charged liquid jets of polymer solutions in electrospinning," Journal of Applied Physics, 2000, 87, No. 9, pp. 4531-4547.

Warner, S. B., Buer, A., Grimler, M., Ugbolue, S.C., Rutledge, G. C. and Shin, M. Y., "A Fundamental Investigation of the Formation and Properties of Electrospun Fibers", "A Fundamental Investigation of the Formation and Properties of Electrospun Fibers", National Textile Center Annual Report, 1999.

* cited by examiner

CONTROLLED ELECTROSPINNING OF FIBERS

BACKGROUND OF THE INVENTION

1. Field of the Invention

The present invention relates generally to electrospinning of fibers and more particularly to controlled electrospinning of fibers.

2. Background Art

Electrospinning has been known, since the 1930's. However, electrospinning of fibers has not previously gained significant industrial importance, owing to a variety of issues, some of these having been low output, inconsistent and low molecular orientation, poor mechanical properties, difficulties and instabilities of fluid streams in forming fibers, and high diameter distribution of the electrospun fibers. Although special needs of military, medical and filtration applications have stimulated recent studies and renewed interest in the electrospinning, quantitative technical and scientific information regarding process and product characterization are extremely limited.

In a typical electrospinning system, a charged polymer solution (or melt) is fed through a small opening or orifice of a nozzle (usually a needle or pipette tip), and because of its charge, the polymer solution is drawn (as a jet) toward a collector, which is often a grounded collecting plate (usually a metal screen, plate, or rotating mandrel), typically 5-30 cm from the orifice of the nozzle. During the jet's travel, the solvent gradually evaporates, and a charged polymer fiber is left to accumulate on the grounded target. The charge on the fibers eventually dissipates into the surrounding environment. The resulting product is a non-woven fiber mat that is composed of tiny fibers with diameters between 50 nanometers and 10 microns. This non-woven mat forms the foundation of a "scaffold". If the target is allowed to move with respect to the nozzle position, specific fiber orientations (parallel alignment or a random) can be achieved. Previous work has shown that varying the fiber diameter and orientation can vary the mechanical properties of the scaffold.

Using electrical forces alone, electrospinning can produce fibers with nanometer diameters. Electrospun fibers have large surface to volume ratios, because of their small diameters, which enable them to absorb more liquids than do fibers having large diameters, and small pore sizes make them suitable candidates for military and civilian filtration applications. It is expected that electrospun fibers will find many applications in composite materials and as reinforcements.

Typically, an electric field is used to draw a positively charged polymer solution from an orifice of a nozzle to a collector, and "electrospin" the polymer solution, as the polymer solution travels from the orifice to the collector. A jet of solution typically flows or travels from the orifice of the nozzle to the collector, which is typically grounded. The jet emerges from the nozzle, which is typically of a conical geometry, and often, in particular, a Taylor cone. The jet transitions to form a stretched jet, after the jet leaves the orifice of the nozzle, and then the jet divides into many fibers in an area called the "splaying region".

As the ionized jet of positively charged polymer solution travels from the orifice to the collector, a "whipping motion" (or bending instability) results in the jet There is thus a need for apparatus and methods that control the jet and minimize instabilities of the jet as it travels from the nozzle to the collector plate. The apparatus and methods should be capable of controlling the jet, the path of the jet, controlling and minimizing instabilities of these fluid streams during formation of fibers, and controlling the direction of the jet and concentration of solution during electrospinning.

The formation of fibers by electrospinning is also impacted by the viscosity of spinnable fluids, since some spinnable fluids are so viscous that they require higher forces than electric fields can typically produce without arcing, i.e., dielectric breakdown of the air. Likewise, these techniques have been problematic where high temperatures are required, since high temperatures typically increase the conductivity of structural parts and complicate the control of high strength electrical fields. The apparatus and methods should, thus, also be capable of controlling the jet and minimizing instabilities for fluids of different viscosities, and should be capable of controlling the jet during the use of extreme temperatures and high strength electrical fields.

The apparatus and methods that control and minimize instabilities of the jet should be capable of improving efficiency, productivity, and economy of the electrospinning process. The apparatus and methods should also be capable of more accurate use of fluids, improvements in production and formation of fibers, and improvements in the production rate, fiber diameter distribution, measure, and characterization of the electrospun fiber properties in terms of size, orientation and mechanical properties.

Different electrospinning apparatus and methods have heretofore been known. However, none of the electrospinning apparatus and methods adequately satisfies these aforementioned needs.

U.S. Pat. No. 6,713,011 (Chu, et al.) discloses an apparatus and method for electrospinning polymer fibers and membranes. The method includes electrospinning a polymer fiber from a conducting fluid in the presence of a first electric field established between a conducting fluid introduction device and a ground source and modifying the first electric field with a second electric field to form a jet stream of the conducting fluid. The method also includes electrically controlling the flow characteristics of the jet stream, forming a plurality of electrospinning jet streams and independently controlling the flow characteristics of at least one of the jet streams. The apparatus for electrospinning includes a conducting fluid introduction device containing a plurality of electrospinning spinnerets, a ground member positioned adjacent to the spinnerets, a support member disposed between the spinnerets and the ground member and movable to receive fibers formed from the conducting fluid, and a component for controlling the flow characteristics of conducting fluid from at least one spinneret independently from another spinneret. U.S. Pat. No. 4,689,186 (Bornat) discloses production of electrostatically spun products, comprising electrostatically spinning a fiberizable liquid, the electrostatic field being distorted by the presence of an auxiliary electrode, preferably so as to encourage the deposition of circumferential fibers, having tubular portions.

U.S. Pat. No. 6,520,425 (Reneker) discloses a process and apparatus for the production of nanofibers, in which a nozzle is used for forming nanofibers by using a pressurized gas stream comprises a center tube, a first supply tube that is positioned concentrically around and apart from the center tube, a middle gas tube positioned concentrically around and apart from the first supply tube, and a second supply tube positioned concentrically around and apart from the middle gas tube. The center tube and first supply tube form a first annular column. The middle gas tube and the first supply tube form a second annular column. The middle gas tube and second supply tube form a third annular column. The tubes are positioned, so that first and second gas jet spaces are created between the lower ends of the center tube and first supply tube, and the middle gas tube and second supply tube, respectively. A method for forming nanofibers from a single nozzle is also disclosed.

U.S. Pat. No. 6,641,773 (Kleinmeyer, et al.) discloses electro spinning of submicron diameter polymer filaments, in which an electro spinning process yields substantially uniform, nanometer diameter polymer filaments. A thread-forming polymer is extruded through an anodically biased die orifice and drawn through an anodically biased electrostatic field. A continuous polymer filament is collected on a grounded collector. The polymer filament is linearly oriented and uniform in quality. The filament is particularly useful for weaving body armor, for chemical/biological protective clothing, as a biomedical tissue growth support, for fabricating micro sieves and for microelectronics fabrication.

U.S. Pat. No. 6,991,702 (Kim) discloses an electrospinning apparatus, including a spinning dope main tank, a metering pump, a nozzle block, a collector positioned at the lower end of the nozzle block for collecting spun fibers, a voltage generator, a plurality of units for transmitting a voltage generated by the voltage generator to the nozzle block and the collector, the electrospinning apparatus containing a spinning dope drop device positioned between the metering pump and the nozzle block the spinning dope drop device having (i) a sealed cylindrical shape, (ii) a spinning dope inducing tube and a gas inletting tube for receiving gas through its lower end and having its gas inletting part connected to a filter aligned side-by-side at the upper portion of the spinning dope drop device, (iii) a spinning dope discharge tube extending from the lower portion of the spinning dope drop device and (iv) a hollow unit for dropping the spinning dope from the spinning dope inducing tube formed at the middle portion of the spinning dope drop device.

U.S. Pat. No. 6,989,125 (Boney, et al.) discloses a process of making a nonwoven web, resulting in continuous fiber nonwoven webs with high material formation uniformity and MD-to-CD balance of fiber directionality and material properties, as measured by a MD:CD tensile ratio of 1.2 or less, and laminates of the nonwoven webs. The invention also includes a method for forming the nonwoven webs, wherein a fiber production apparatus is oriented at an angle less than 90 degrees to the MD direction, and the fibers are subjected to deflection by a deflector oriented at an angle B, with respect to the centerline of the fiber production apparatus, where B is about 10 to about 80 degrees.

U.S. Pat. No. 4,233,014 (Kinney) discloses a process and apparatus for forming a non-woven web in which a bundle of untwisted filaments are charged upstream of a pair of elastomer covered counter rotating squeeze rolls and propelled through the nip of the rolls to a moving laydown belt, with the assistance of an electrostatic field developed between the rolls and the belt.

U.S. Pat. No. 6,616,435 (Lee, et al.) discloses an electrospinning method and apparatus for manufacturing a porous polymer web, which includes the steps of: forming, pressurizing and supplying at least one or more kinds of polymer materials in a liquid state; and discharging and piling the polymer materials to a collector through one or more charged nozzles, the collector being located under the nozzles and charged to have a polarity opposing the polarity of the charged nozzles, the collector moving at a prescribed speed.

U.S. Pat. No. 5,744,090 (Jones, et al.) discloses a process for the manufacture of conductive fibers, usable in electrostatic cleaning devices, in which the conductive fiber is formed from a mixture, including at least one fiber forming material and conductive magnetic materials, and the conductive magnetic materials are migrated toward the periphery of the fiber by application of a magnetic field to the fiber. The conductive fibers having the conductive magnetic materials located at the periphery of the fiber are preferably incorporated into an electrostatic cleaning device for use in an electrostatographic printing device.

U.S. Pat. No. 5,817,272 (Frey, et al.) discloses a process of making a biocompatible porous hollow fiber that is made of polyolefin material and is coated with a biocompatible carbon material is disclosed. The biocompatible hollow fiber produced can be used as exchange material, diaphragms and/or semipermeable membranes within devices, which will contact blood or plasma outside of the living body. The coated fiber is produced by introducing a preformed porous hollow fiber into an atmosphere of gaseous monomer vinylidene chloride and subsequent induction, e.g. by gamma radiation, of a graft-polymerization reaction to form a uniform polyvinylidene chloride layer. The ultimate coating is formed after a dehydrochlorination reaction in which hydrogen chloride is removed from the layer. The dechlorination reaction is typically performed by treating the fiber with hot concentrated aqueous ammonia solution. The reaction can be continued to reduce the chlorine content of the coating to less than 6% of its original value.

U.S. Pat. No. 6,858,168 (Vollrath, et al.) discloses an apparatus and method for forming a liquid spinning solution into a solid formed product, whereby the solution is passed through at least one tubular passage, having walls formed at least partly of semipermeable and/or porous material. The semipermeable and/or porous material allows certain parameters, such as the concentration of hydrogen ions, water, salts and low molecular weight, of the liquid spinning solution to be altered as the spinning solution passes through the tubular passage(s).

U.S. Pat. No. 6,444,151 (Nguyen, et al.) discloses an apparatus and process for spinning polymeric filaments, in which a melt spinning apparatus for spinning continuous polymeric filaments, includes a first stage gas inlet chamber adapted to be located below a spinneret and optionally a second stage gas inlet chamber located below the first stage gas inlet chamber. The gas inlet chambers supply gas to the filaments to control the temperature of the filaments. The melt spinning apparatus also includes a tube located below the second stage gas inlet chamber, for surrounding the filaments as they cool. The tube may include an interior wall having a converging section, optionally followed by a diverging section.

U.S. Pat. No. 6,110,590 (Zarkoob, et al.) discloses synthetically spun silk nanofibers and a process for making the same, in which a silk nanofiber composite network is produced by forming a solution of silk fiber and hexafluroisopropanol, wherein the step of forming is devoid of any acid treatment, where the silk solution has a concentration of about 0.2 to about 1.5 weight percent silk in hexafluroisopropanol, and where the silk is selected from Bombyx mori silk and Nephila clavipes silk; and electrospinning the solution, thereby forming a non-woven network of nanofibers having a diameter in the range from about 2 to about 2000 nanometers.

U.S. Pat. No. 6,265,466 (Glatkowski, et al.) discloses an electromagnetic shielding composite having nanotubes and a method of making the same. According to one embodiment, the composite for providing electromagnetic shielding includes a polymeric material and an effective amount of oriented nanotubes for EM shielding, the nanotubes being oriented when a shearing force is applied to the composite. According to another embodiment of the invention, the method for making an electromagnetic shielding includes the steps of (1) providing a polymer with an amount of nanotubes, and (2) imparting a shearing force to the polymer and nanotubes to orient the nanotubes.

U.S. Pat. No. 6,656,394 (Kelly) discloses a method and apparatus for high throughput generation of fibers by charge injection, in which a fiber is formed by providing a stream of a solidifiable fluid, injecting the stream with a net charge, so as to disrupt the stream and allowing the stream to solidify to form fibers.

U.S. Pat. Nos. 6,955,775 and 7,070,640 (Chung, et al.) disclose a process of making fine fiber material, including improved polymer materials and fine fiber materials, which can be made from the improved polymeric materials, in the form of microfiber and nanofiber structures. The microfiber and nanofiber structures can be used in a variety of useful applications including the formation of filter materials.

U.S. Pat. No. 6,753,454 (Smith, et al.) discloses electrospun fibers and an apparatus therefor. A fiber comprising a substantially homogeneous mixture of a hydrophilic polymer and a polymer, which is at least weakly hydrophobic is disclosed. The fiber optionally contains a pH adjusting compound. A method of making the fiber comprises electrospinning fibers of the substantially homogeneous polymer solution. A method of treating a wound or other area of a patient requiring protection from contamination comprises electrospinning the substantially homogeneous polymer solution to form a dressing. An apparatus for electrospinning a wound dressing is disclosed.

U.S. Pat. No. 5,911,930 (Kinlen, et al.) discloses solvent spinning of fibers containing an intrinsically conductive polymer, including a fiber containing an organic acid salt of an intrinsically conductive polymer distributed throughout a matrix polymer along, with a method for providing such fibers by spinning a solution, which includes an organic acid salt of an intrinsically conductive polymer, a matrix polymer, and a spinning solvent into a coagulation bath including a nonsolvent for both the organic acid salt of an intrinsically conductive polymer and the matrix polymer. The intrinsically conductive polymer-containing fibers typically have electrical conductivities below about 10.sup.−5 S/cm.

U.S. Pat. No. 6,695,992 (Reneker) discloses a process and apparatus for the production of nanofibers, including an apparatus for forming a non-woven mat of nanofibers, by using a pressurized gas stream, which includes parallel, spaced apart, first, second, and third members, each having a supply end and an opposing exit end. The second member is located apart from and adjacent to the first member. The exit end of the second member extends beyond the exit end of the first member. The first and second members define a first supply slit. The third member is located apart from and adjacent to the first member on the opposite side of the first member from the second member. The first and third members define a first gas slit, and the exit ends of the first, second and third members define a gas jet space. A method for forming a non-woven mat of nanofibers utilizes this nozzle.

U.S. Pat. No. 7,070,723 (Ruitenberg, et al.) discloses a method for spin-drawing of melt-spun yarns. A method is provided for simultaneous spin-drawing of continuous yarns consisting of one or more filaments, comprising the steps in which a melt of a thermoplastic material is fed to a spinning device, the melt is extruded through a spinneret, by means of extrusion openings with the formation of continuous yarns, the continuous yarns are cooled by feeding them through a first and a second cooling zone, wherein the continuous yarns are cooled essentially by a stream of air on passing through the first cooling zone and essentially by a fluid, consisting wholly or partly of a component that is liquid at room temperature, on passing through the second cooling zone, and the continuous yarns are then dried, subsequently drawn and wound up by means of winding devices, the method being distinguished in that the continuous yarns are fed through the first and second cooling zones at a speed of up to 500 m/min and that the residence time of the continuous yarns within the first cooling zone is at least 0.1 sec.

U.S. Pat. No. 7,105,058 (Sinyagin) discloses an apparatus and method for forming a microfiber coating, which includes directing a liquid solution toward a deposition surface. The apparatus includes a tube defining a volume through which the liquid solution travels. An electric field is applied between the origin of the liquid solution and the surface. A gas is injected into the tube to create a vortex flow within the tube. This vortex flow protects the deposition surface from entrainment of ambient air from the surrounding atmosphere.

U.S. Pat. No. 7,105,812 (Zhao, et al.) discloses a microfluidic chip with enhanced tip for stable electrospray ionization, in which a microfluidic chip is formed with multiple fluid channels terminating at a tapered electrospray ionization tip for mass spectrometric analysis. The fluid channels may be formed onto a channel plate that is in fluid communication with corresponding reservoirs. The electrospray tip can be formed along a defined distal portion of the channel plate that can include a single or multiple tapered surfaces. The fluid channels may terminate at an open-tip region of the electrospray tip. A covering plate may substantially enclose most portions of the fluid channels formed on the channel plate except for the open-tip region. Another aspect of the invention provides methods for conducting mass spectrometric analyses of multiple samples flowing through individual fluid channels in a single microfluidic chip that is formed with a tapered electrospray tip having an open-tip region.

U.S. Pat. No. 5,296,172 (Davis, et al.) discloses an electrostatic field enhancing process and apparatus for improved web pinning and uniformity in a fibrous web forming operation. The improvements are achieved by imposing an auxiliary electrostatic field above the fibrous web as it is pinned along a moving collection surface. An auxiliary electrostatic field enhancing plate is positioned above the web and collection surface and downstream of the laydown position where the web initially is deposited on the collection surface. The plate enhances the electrostatic field in the region above the collection surface and thereby increases the web pinning forces. When the invention is applied to a flash-spinning process, where trifluorochloromethane is used as the fluid medium, an auxiliary electrostatic field of between about 2 and 80 kV/cm, preferably between about 10 and 60 kV/cm, is applied by the plate.

U.S. Pat. No. 3,860,369 (Berthauer, et al.) and U.S. Pat. No. 3,851,023 (Berthauer, et al.) disclose apparatus for making non-woven fibrous sheet and a process for forming a web; U.S. Pat. No. 3,319,309 (Owens) discloses charged web collecting apparatus; and U.S. Pat. No. 3,689,608 (Hollbert, et al.) discloses a process for forming a nonwoven web.

U.S. Pat. No. 4,965,110 (Berry) and U.S. Pat. No. 5,024,789 (Berry) disclose a method and apparatus for manufacturing an electrostatically spun structure; U.S. Pat. No. 4,044,404 (Martin, et al.) discloses a fibrillar lining for a prosthetic device prepared by electrostatically spinning an organic material and collecting the spun fibers on a receiver; and U.S. Pat. No. 3,169,899 (Steuber) discloses non woven fibrous sheet of continuous strand material and the method of making same.

U.S. Pat. No. 7,105,124 (Choi) discloses a method, apparatus, and product for manufacturing nanofiber media; U.S. Pat. No. 7,081,622 (Kameoka, et al.) discloses an electrospray emitter for a microfluidic channel; U.S. Pat. No. 6,106,913 (Scardino, et al.) discloses fibrous structures containing nanofibrils and other textile fibers; U.S. Pat. No. 6,709,623 (Haynes, et al.) discloses a process of and apparatus for making a nonwoven web; and U.S. Pat. No. 6,790,528 (Wendroff, et al.) discloses production of polymer fibers having nanoscale morphologies.

Reneker, D. H., Yarin, A. L., Fong, H., and Koombhongse, S., "Bending instability of electrically charged liquid jets of polymer solutions in electrospinning," Journal of Applied Physics, 2000, 87, No 9, pp. 4531-4547 discloses bending instability of electrically charged liquid jets of polymer solutions in electrospinning. Nanofibers of polymers were electrospun by creating an electrically charged jet of polymer solution at a pendent droplet. After the jet flowed away from the droplet in a nearly straight line, the jet bent into a complex path and other changes in shape occurred, during which electrical forces stretched and thinned it by very large ratios. After the solvent evaporated, birefringent nanofibers were left. The reasons for the instability are analyzed and explained, using a mathematical model. The rheological complexity of the polymer solution is included, which allows consideration of viscoelastic jets. It is shown that the longitudinal stress caused by the external electric field acting on the charge carried by the jet stabilized the straight jet for some distance. Then a lateral perturbation grew in response to the repulsive forces between adjacent elements of charge carried by the jet. The motion of segments of the jet grew rapidly into an electrically driven bending instability. The three-dimensional paths of continuous jets were calculated, both in the nearly straight region, where the instability grew slowly and in the region where the bending dominated the path of the jet. The mathematical model provides a reasonable representation of the experimental data, particularly of the jet paths determined from high speed videographic observations Warner, S. B., Buer, A., Grimler, M., Ugbolue, S. C., Rutledge, G. C. and Shin, M. Y., "A Fundamental Investigation of the Formation and Properties of Electrospun Fibers", National Textile Center Annual Report, 1998 discusses the fundamental engineering science and technology of electrostatic fiber production ("electrospinning"). Electrospinning and its capabilities for producing novel synthetic fibers of unusually small diameter and good mechanical performance ("nanofibers"), and fabrics with controllable pore structure and high surface area are discussed. The following items are included: design and construction of process equipment for controllable and reproducible electrospinning; clarification of the fundamental electrohydrodynamics of the electrospinning process and, correlation to the polymer fluid characteristics; characterization and evaluation of the fluid instabilities postulated to be crucial for producing ultrafine diameter fibers; characterization of the morphology and material properties of electrospun polymer fibers; development of techniques for generating oriented fibers and yarns by the electrospinning process; and productivity improvement of the electrospinning process.

For the foregoing reasons, there is a need for apparatus and methods that control the jet and minimize instabilities of the jet as it travels from the nozzle to the collector plate. The apparatus and methods should be capable of controlling the jet, the path of the jet, and the concentration of solution during electrospinning.

The apparatus and methods should also be capable of controlling the jet and minimizing instabilities for fluids of different viscosities, and should be capable of controlling the jet, during the use of extreme temperatures and high strength electrical fields.

The apparatus and methods that control and minimize instabilities of the jet should be capable of improving efficiency, productivity, and economy of the electrospinning process. The apparatus and methods should also be capable of more accurate use of fluids, improvements in production and formation of fibers, and improvements in the production rate, fiber diameter distribution, measure, and characterization of the electrospun fiber properties in terms of size, orientation and mechanical properties.

SUMMARY

The present invention is directed to electrospinning apparatus and methods that control a jet or jets of solution during the electrospinning process. The apparatus and methods minimize instabilities of the jet(s) as it travels from the nozzle to the collector plate. The apparatus and methods are capable of controlling the jet(s), the path of the jet(s), and the concentration of solution during electrospinning.

The apparatus and methods are also capable of controlling the jet(s) and minimizing instabilities for fluids of different viscosities, and are capable of controlling the jet(s), during the use of extreme temperatures and high strength electrical fields.

The apparatus and methods that control and minimize instabilities of the jet(s) are also capable of improving efficiency, productivity, and economy of the electrospinning process. The apparatus and methods are capable of more accurate use of fluids, improvements in production and formation of fibers, and improvements in the production rate, fiber diameter distribution, measure, and characterization of the electrospun fiber properties in terms of size, orientation and mechanical properties.

An electrospinning apparatus for spinning a polymer fiber from a fluid comprising a polymer having features of the present invention comprises: at least one collector; a jet supply device delivering a quantity of fluid; the jet supply device in electrical communication with the at least one collector, the jet supply device and the at least one collector adapted to form an electric field therebetween and direct the quantity of fluid from the jet supply device toward the at least one collector; at least one magnet forming a magnetic field between the at least jet supply device and the at least one collector; the at least one collector drawing the quantity of fluid toward the at least one collector and forming the quantity of fluid into at least one polymer fiber at the at least one collector of the plurality of collectors; the magnet controlling dispersion characteristics of the quantity of fluid.

An electrospinning method for spinning a polymer fiber from a fluid comprising a polymer in the presence of an electric field established between at least one collector and a jet supply device, having features of the present invention comprises: a) forming an electrospinning jet stream of the fluid directed toward the at least one collector; b) controlling dispersion characteristics of the fluid by applying a magnetic field between the jet supply device and the at least one collector; c) forming at least one polymer fiber at the at least one collector.

Another electrospinning apparatus for spinning a polymer fiber from a fluid comprising a polymer having features of the present invention comprises: a plurality of collectors; a jet supply device delivering a quantity of fluid; the jet supply device in electrical communication with the plurality of collectors, the jet supply device and the plurality of collectors adapted to form an electric field therebetween and direct the quantity of fluid from the jet supply device toward the plurality of collectors; a controller controlling dispersion characteristics of the quantity of fluid by applying different voltages to at least two collectors of the plurality of collectors and influencing the electric field; at least one collector of the plurality of collectors drawing the quantity of fluid toward the at least one collector and forming the quantity of fluid into at least one polymer fiber at the at least one collector of the plurality of collectors. Another electrospinning method for spinning a polymer fiber from a fluid comprising a polymer in the presence of an electric field established between a plurality of collectors and a jet supply device having features of the present invention comprises: a) forming an electrospinning jet stream of the fluid directed toward the plurality of collectors; b) controlling dispersion characteristics of the fluid by applying different voltages to at least two collectors of the plurality of collectors; c) forming at least one polymer fiber at least one collector of the plurality of collectors.

DRAWINGS

These and other features, aspects, and advantages of the present invention will become better understood with regard to the following description, appended claims, and accompanying drawings where:

DESCRIPTION

The preferred embodiments of the present invention will be described with reference to FIGS. 1-9 of the drawings. Identical elements in the various figures are identified with the same reference numbers.

During electrospinning, typically, an electric field is used to draw a positively charged polymer solution from an orifice of a nozzle to a collector, and "electrospin" the polymer solution, as the polymer solution travels from the orifice to the collector. A jet of solution typically flows or travels from the orifice of the nozzle to the collector, which is typically grounded. The jet emerges from the nozzle, which is typically of a conical geometry, and often, in particular, a Taylor cone. The jet transitions to form a stretched jet, after the jet leaves the orifice of the nozzle, and then the jet divides into many fibers in an area called the "splaying region".

As the ionized jet of positively charged polymer solution travels from the orifice to the collector, a "whipping motion" (or bending instability) results in the jet.

As the ionized jet of positively charged polymer solution travels from the orifice of the jet to the collector, a magnetic field is induced, which creates the whipping motion (or bending instability) of the jet. The magnetic field is induced by the motion of the charged polymer solution, or in other words, by the motion of charged particles of the polymer solution.

The whipping motion (or bending instability) may be controlled by controlling the magnetic field in the vicinity of the jet and/or controlling the electric field in the vicinity of the jet.

Figure 1:
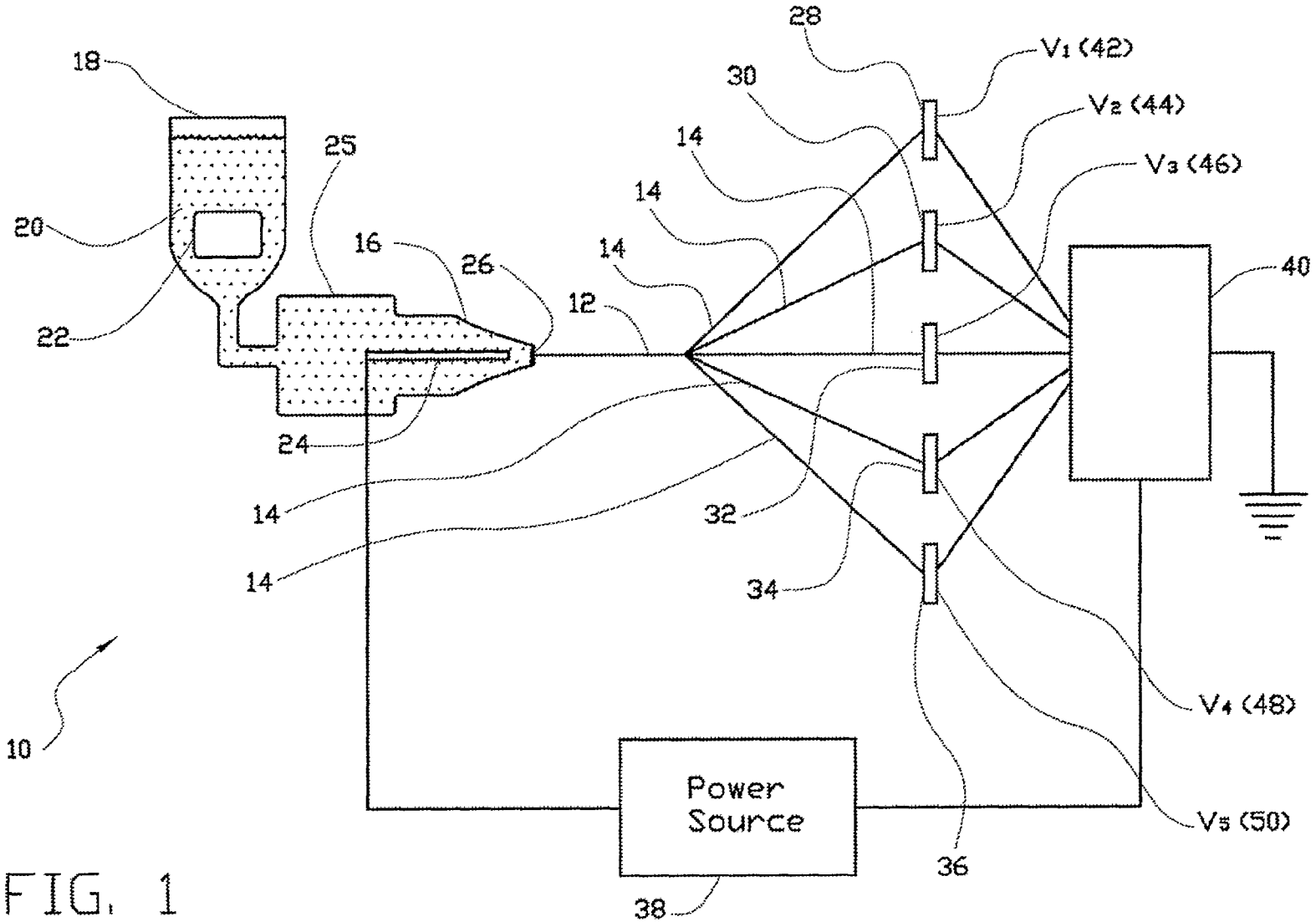
FIG. 1 is a schematic representation of an electrospinning apparatus, having electric field control using different collector voltages, constructed in accordance with the present invention.

FIG. 1 shows an embodiment of the present invention, an electrospinning apparatus 10, which controls whipping motion of a jet 12 of charged polymer solution, hereinafter designated as the jet 12, during electrospinning of polymer fibers 14. The electrospinning apparatus 10 has jet supply device 16, which has reservoir 18 having polymer solution 20 therein and mixer 22 for mixing the polymer solution 20, electrode 24, pump 25 for pumping the polymer solution 20 from the reservoir 18, and orifice 26 for discharging the jet 12 from the jet supply device 16. The electrospinning apparatus 10 has collectors 28, 30, 32, 34, and 36 for collecting the polymer fibers 14, power source 38, and voltage controller 40, the power source 38 in electrical communication with and supplying power to the electrode 24 and the voltage controller 40. The voltage controller 40 is in electrical communication with and provides power to each of the collectors 28, 30, 32, 34, and 36, voltages $V_1$ (42), $V_2$ (44), $V_3$ (46), $V_4$ (48), and $V_5$ (50) to each of the collectors 28, 30, 32, 34, and 36. The potential difference between the collectors 28, 30, 32, 34, and 36 and the electrode 24 draws the jet 12 from the jet supply device 16 toward the collectors 28, 30, 32, 34, and 36, the polymer fibers 14 being formed, upon approaching the collectors 28, 30, 32, 34, and 36, and collected at the collectors 28, 30, 32, 34, and 36. At least two of the voltages $V_1$ (42), $V_2$ (44), $V_3$ (46), $V_4$ (48), and $V_5$ (50) at the collectors 28, 30, 32, 34, and 36 are set to be different from each other, as a means of controlling the electric fields between the electrode 24 and each of the collectors 28, 30, 32, 34, and 36, and, thus, controlling the whipping motion of the jet 12 and stabilizing bending motion of the jet 12. The voltage controller 40, thus, may be used to focus the jet 12, which typically travels from the orifice 26 in a rapidly rotating spiral motion. The electrospinning apparatus 10 uses electrostatic focusing. The dispersion of the jet 12 is controlled by controlling the electric field in the vicinity of the jet 12 of the electrospinning apparatus 10.

Figure 2:
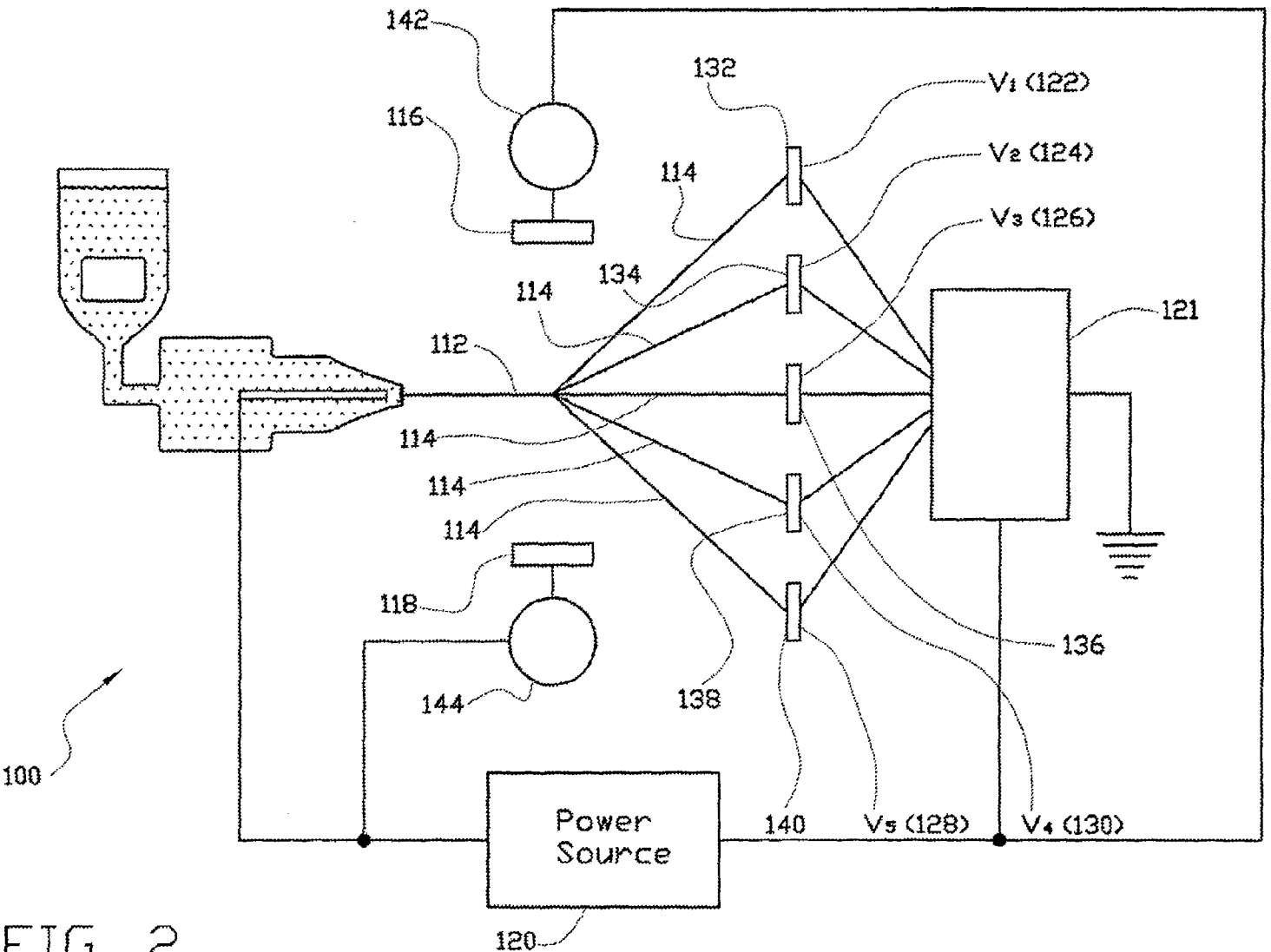
FIG. 2 is a schematic representation of an alternate embodiment of an electrospinning apparatus, having electric field control using different collector voltages and transverse electric field control of a jet of the electrospinning apparatus.

FIG. 2 shows an alternate embodiment of the present invention, an electrospinning apparatus 100, which controls whipping motion of a jet 112 of charged polymer solution, hereinafter designated as the jet 112, during electrospinning of polymer fibers 114, which is substantially the same as the electrospinning apparatus 10, except that the electrospinning apparatus 100 has electrodes 116 and 118, in communication with and powered by power source 120, which generates an electric field between the electrodes 116 and 118 substantially transverse to the jet 112 and further aids in controlling whipping motion of the jet 112 and stabilizing bending motion of the jet 112. The electrospinning apparatus 100 also has voltage controller 121 to control voltages $V_1$ (122), $V_2$ (124), $V_3$ (126), $V_4$ (128), and $V_5$ (130) at each of collectors 132, 134, 136, 138, and 140, and voltage controllers 142 and 144 to control the voltages at the electrodes 116 and 118, and control the whipping motion of the jet 112 and stabilize bending motion of the jet 112. Power to the voltage controllers 121, 142, and 144 is supplied by the power source 120. The electrospinning apparatus 100 uses electrostatic focusing. Controlling the electric fields between the electrodes 116 and 118 and each of the collectors 132, 134, 136, 138, and 140 and the electric field generated between the electrodes 116 and 118, which the jet 112 passes through and which also impacts the jet 112, further enhances the ability of the electrospinning apparatus 110 to control the whipping motion of the jet 112 and stabilize the bending motion of the jet 112.

Figure 3:
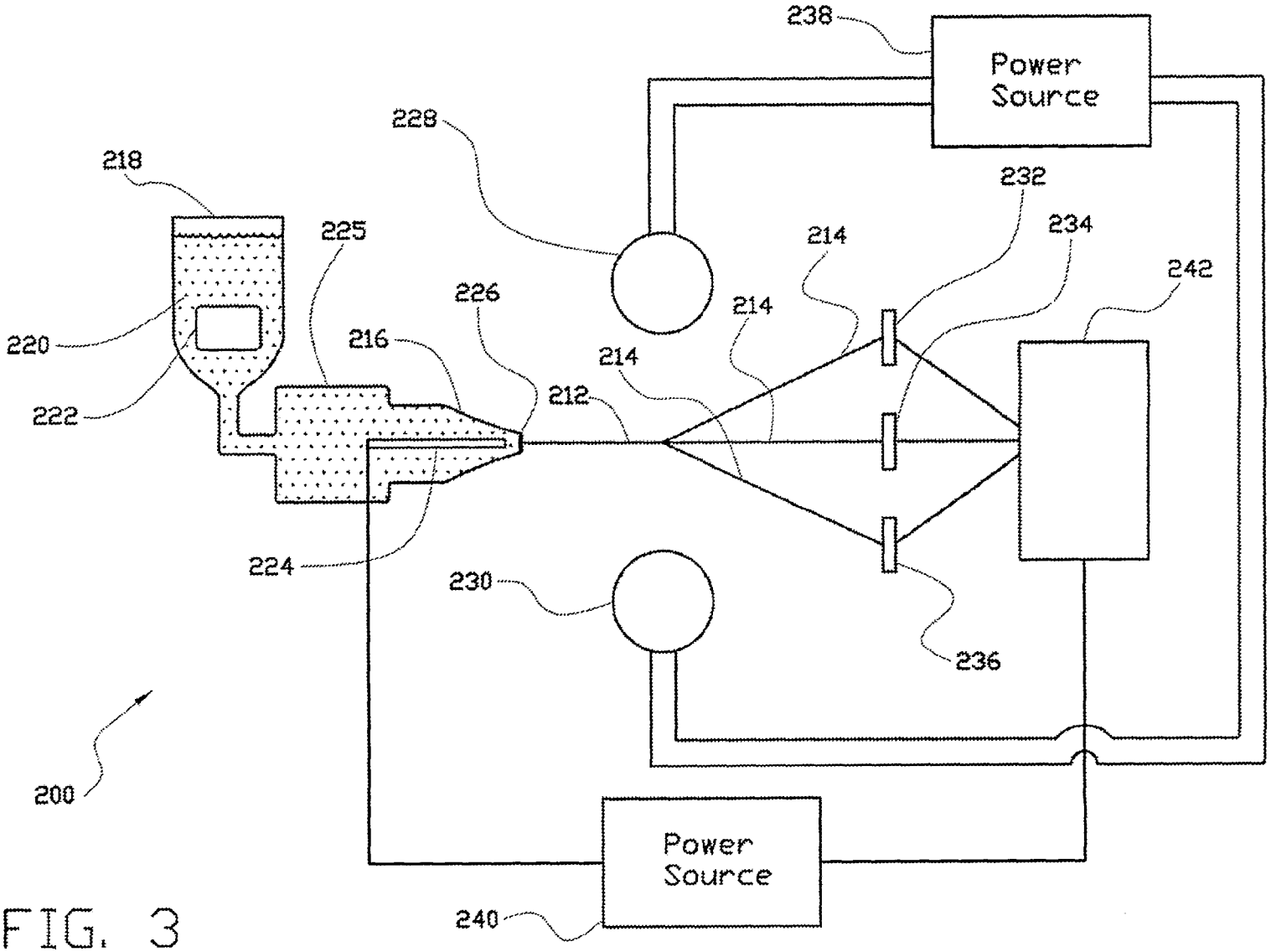
FIG. 3 is a schematic representation of an alternate embodiment of an electrospinning apparatus, having transverse magnetic field control of a jet of the electrospinning apparatus.

FIG. 3 shows an alternate embodiment of the present invention, an electrospinning apparatus 200, which controls whipping motion of a jet 212 of charged polymer solution, hereinafter designated as the jet 212, during electrospinning of polymer fibers 214. The electrospinning apparatus 200 has jet supply device 216, which has reservoir 218 having polymer solution 220 therein and mixer 222 for mixing the polymer solution 220, electrode 224, pump 225 for pumping the polymer solution 220 from the reservoir 218, and orifice 226 for discharging the jet 212 from the jet supply device 216. The electrospinning apparatus 200 has magnets 228 and 230, which generate a magnetic field substantially transverse to the jet 212, which are preferably electromagnets and offer control of the magnetic field generated between the magnets 228 and 230. The electrospinning apparatus 200 has collectors 232, 234, and 236 for collecting the polymer fibers 214, power source 238 in electrical communication with and supplying power to the magnets 228 and 230, and power source 240 in electrical communication with and supplying power to the electrode 224 and the collectors 232, 234, and 236. The electrospinning apparatus 200 uses magnetic focusing. The electrospinning apparatus 200 also has voltage controller 242 for regulating voltage to the collectors 232, 234, and 236, if desired. The dispersion of the jet 212 is controlled by controlling the magnetic field in the vicinity of the jet 212 of the electrospinning apparatus 200.

Figure 4:
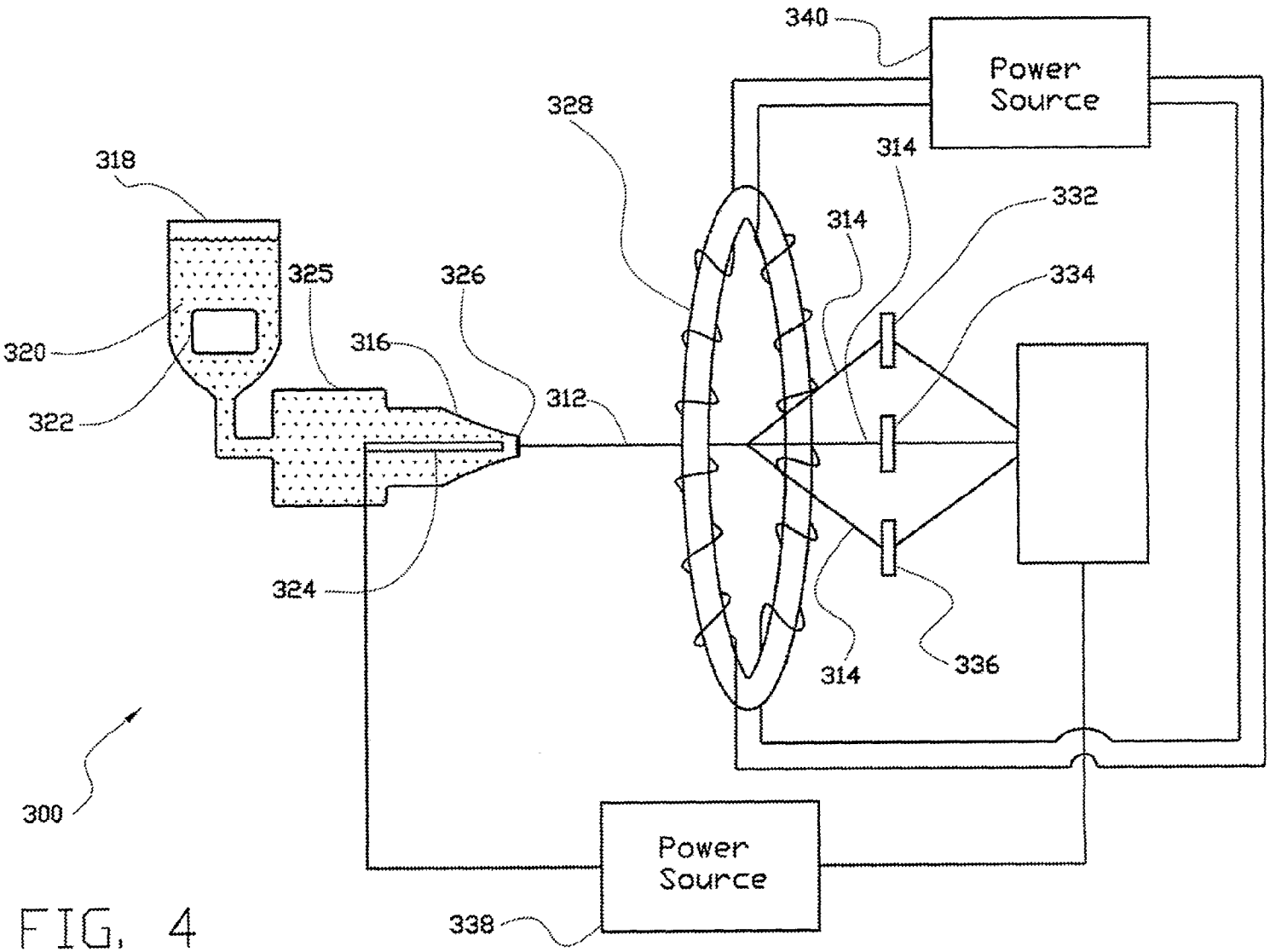
FIG. 4 is a schematic representation of an alternate embodiment of an electrospinning apparatus, having magnetic focusing control of a jet of the electrospinning apparatus.

FIG. 4 shows an alternate embodiment of the present invention, an electrospinning apparatus 300, which controls whipping motion of a jet 312 of charged polymer solution, hereinafter designated as the jet 312, during electrospinning of polymer fibers 314. The electrospinning apparatus 300 has jet supply device 316, which has reservoir 318 having polymer solution 320 therein and mixer 322 for mixing the polymer solution 320, electrode 324, pump 325 for pumping the polymer solution 320 from the reservoir 318, and orifice 326 for discharging the jet 312 from the jet supply device 316. The electrospinning apparatus 300 has an electromagnet 328 about the jet 312, for controlling the dispersion of the jet 312. The electrospinning apparatus 300 has collectors 332, 334, and 336 for collecting the polymer fibers 314, power source 338 in electrical communication with and supplying power to the electromagnet 328, and power source 340 in electrical communication with and supplying power to the electrode 324 and the collectors 332, 334, and 336. The electrospinning apparatus 300 uses magnetic focusing. The dispersion of the jet 312 is controlled by controlling the magnetic field developed by the electromagnet 328 in the vicinity of the jet 312 of the electrospinning apparatus 300. The electromagnet 328 typically comprises a toroid having a high permeability magnetic core and a conductive winding thereabout although other suitable construction may be used.

Figure 5:
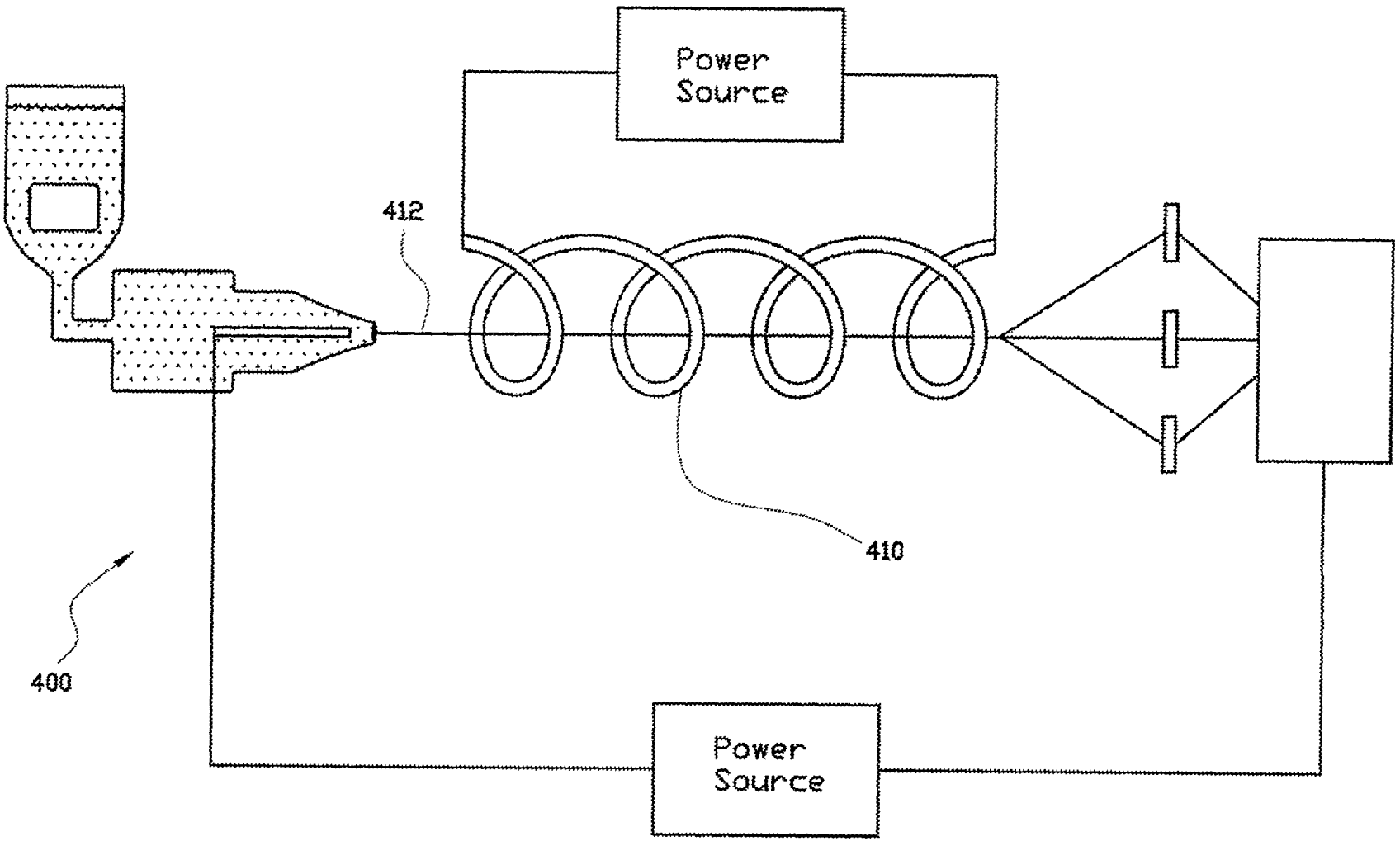
FIG. 5 is a schematic representation of an alternate embodiment of an electrospinning apparatus, having magnetic induction control of a jet of the electrospinning apparatus.

FIG. 5 shows an alternate embodiment of the present invention, an electrospinning apparatus 400, which is substantially the same as the electrospinning apparatus 300, except that the electrospinning apparatus 400, has helical coil 410, which induces a magnetic field in the vicinity of the jet 412, and controls the dispersion of the jet 412.

Figure 6:
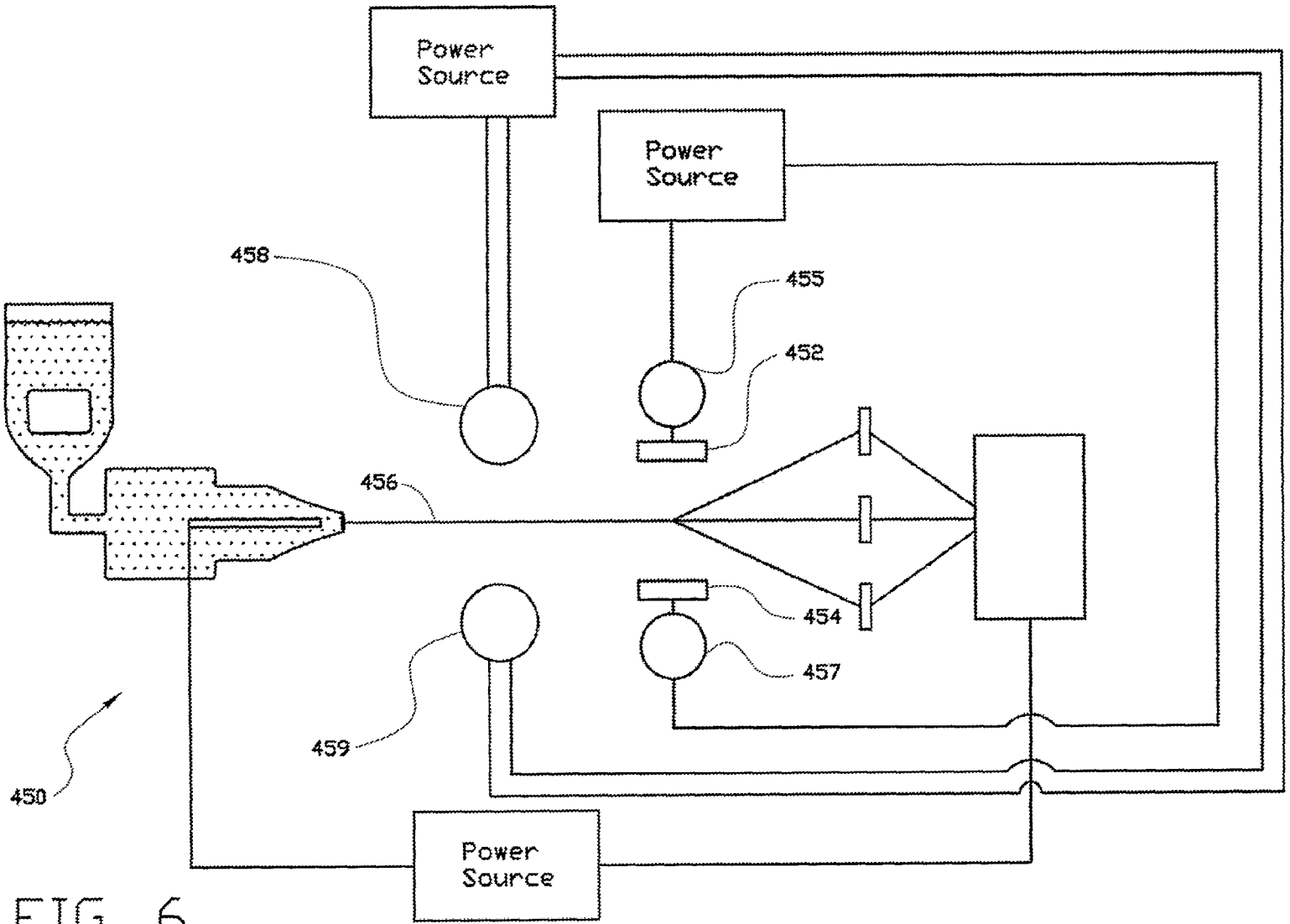
FIG. 6 is a schematic representation of an alternate embodiment of an electrospinning apparatus, having transverse magnetic field control and transverse electric field control of a jet of the electrospinning apparatus.

FIG. 6 shows an alternate embodiment of the present invention, an electrospinning apparatus 450, which is substantially the same as the electrospinning apparatus 200, except that the electrospinning apparatus 450 controls the electric field generated between electrodes 452 and 454, which is substantially transverse to jet 456 and is controlled by voltage controllers 455 and 457, in addition to controlling the magnetic field generated by magnets 458 and 459, which is also substantially transverse to the jet 456. The dispersion of the jet 456 is controlled by controlling the magnetic field and the electric field in the vicinity of the jet 456 of the electrospinning apparatus 450.

Figure 7:
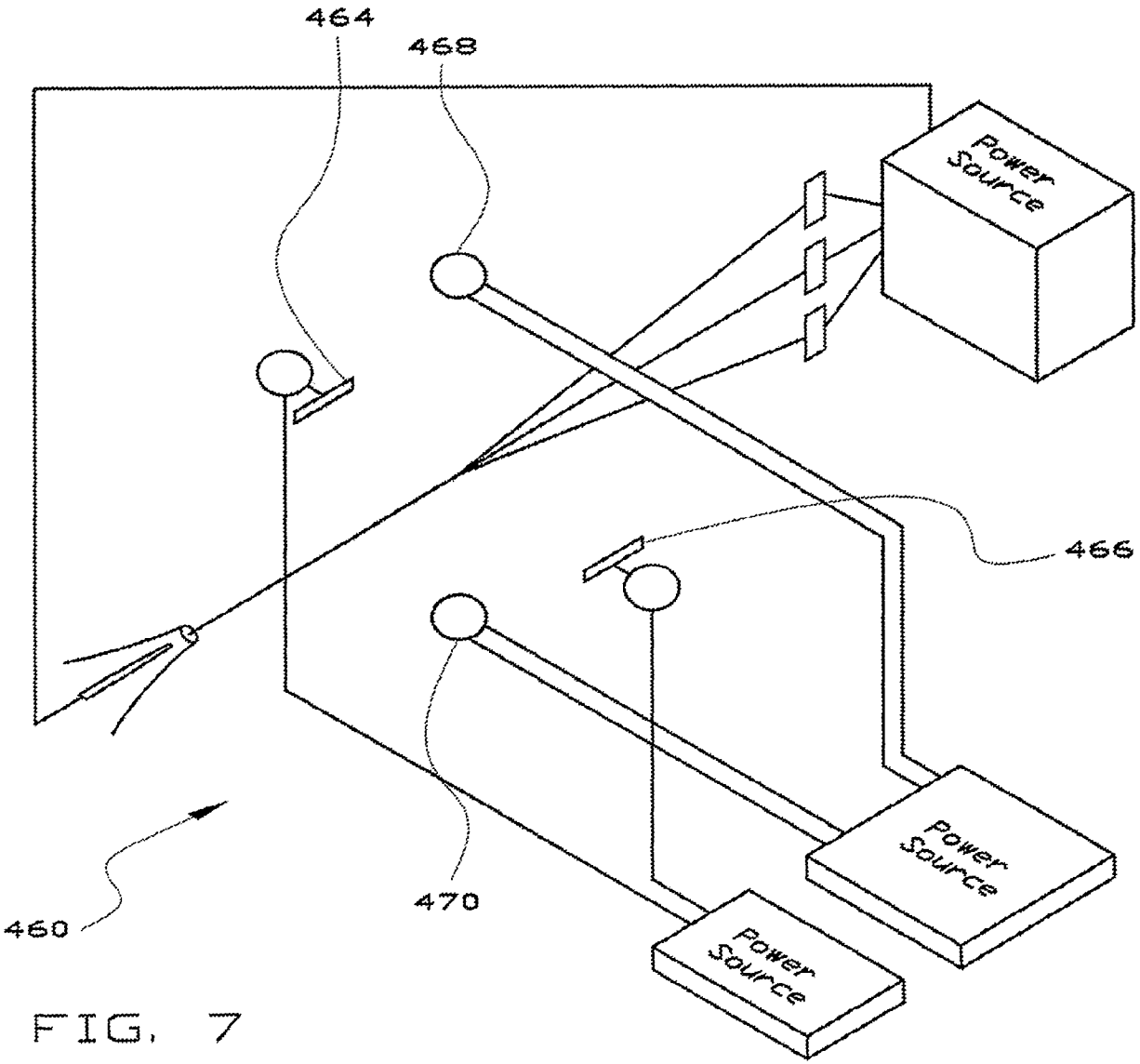
FIG. 7 is a perspective view of an alternate embodiment of an electrospinning apparatus, having transverse magnetic field control and transverse electric field control of a jet of the electrospinning apparatus.

FIG. 7 is a perspective view of an alternate embodiment of the present invention, an electrospinning apparatus 460, which is substantially the same as the electrospinning apparatus 450, except that the electrospinning apparatus 460 has electrodes 464 and 466 and magnets 468 and 470, the electrodes 464 and 466 opposing one another and located in substantially the same plane as the magnets 468 and 470, which are also opposing one another, the electrodes 464 and 466 substantially perpendicular to the magnets 468 and 470, respectively.

In the present invention, the electrospinning apparatus 460 is having transverse magnetic field control and transverse electric field control of a jet of the electrospinning apparatus 460.

Figure 8:
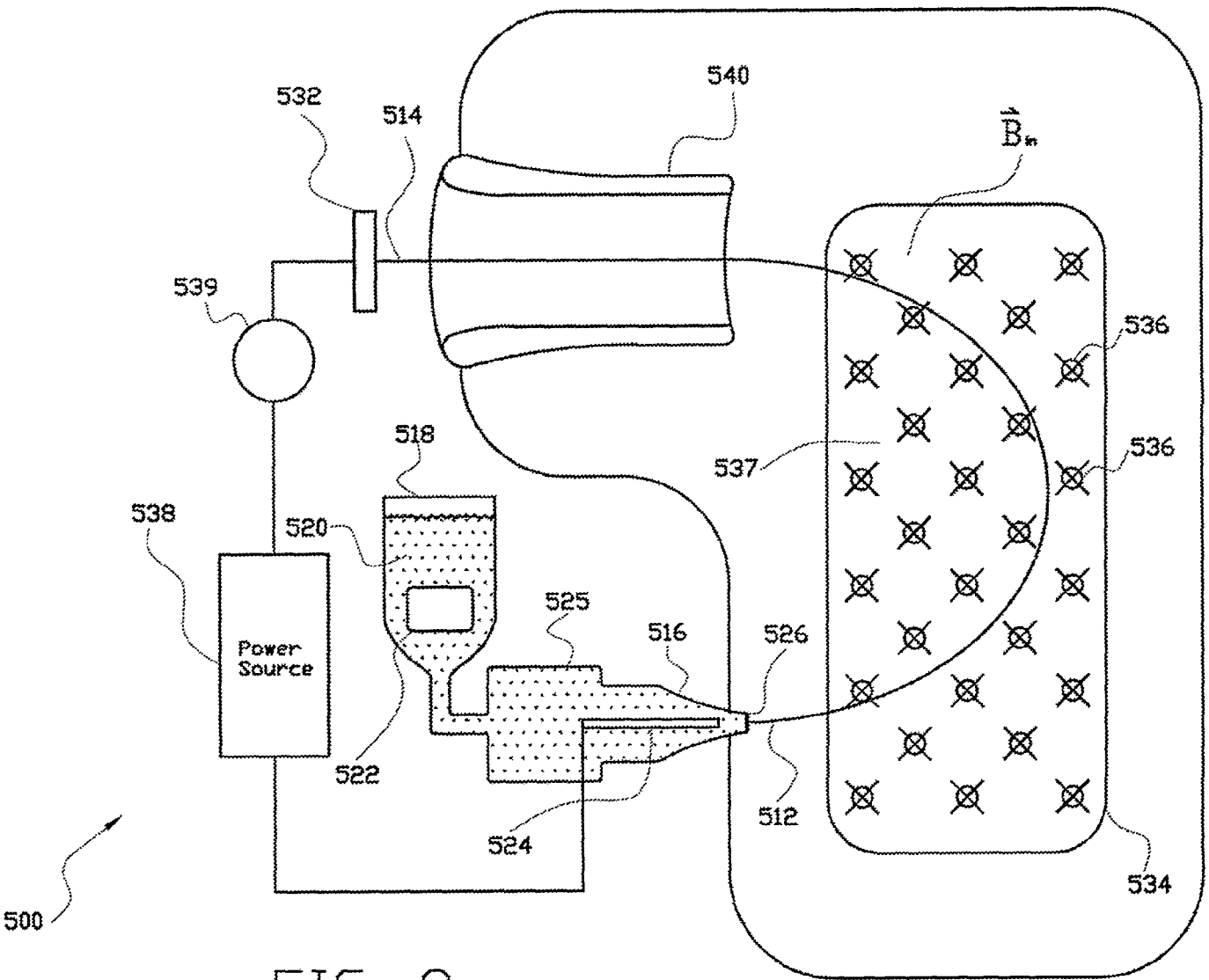
FIG. 8 is a schematic representation of an alternate embodiment of an electrospinning apparatus, having magnetic bending control of a jet of the electrospinning apparatus.

FIG. 8 shows an alternate embodiment of the present invention, an electrospinning apparatus 500, which controls whipping motion of a jet 512 of charged polymer solution, hereinafter designated as the jet 512, during electrospinning of polymer fibers 514. The electrospinning apparatus 500 has jet supply device 516, which has reservoir 518 having polymer solution 520 therein and mixer 522 for mixing the polymer solution 520, electrode 524, pump 525 for pumping the polymer solution 520 from the reservoir 518, and orifice 526 for discharging the jet 512 from the jet supply device 516. The electrospinning apparatus 500 has collector 532 for collecting the polymer fibers 514, power source 538 in electrical communication with and supplying power to voltage controller 539, which is in electrical communication with and supplying power to the electrode 524 and the collector 532. The electrospinning apparatus 500 has magnet 534, which generates a substantially constant uniform magnetic field represented by flux lines 536, and which results in the jet 512 taking a substantially circular path through bending zone 537 at a substantially constant speed. The electrospinning apparatus 500 also has magnet deflection yoke 540, which aids in magnetic focusing and further directs the jet 512 toward the collector 532, the magnetic deflection yoke preferably being similar in construction to the electromagnet 328 of the electrospinning apparatus 300, although other suitable construction may be used. The electrospinning apparatus 500 uses magnetic focusing. The dispersion of the jet 512 is controlled by controlling the magnetic flux lines developed by the magnet 534 in the bending zone 537 and the magnetic field developed by the magnetic deflection yoke 540 in the vicinity of the jet 512 of the electrospinning apparatus 500. It should be noted that the jet 512 is deflected by substantially 180 degrees after exiting the orifice 526 by the time the jet arrives at the collector 532, although other suitable angles may be used, such as, for example, 90 degrees, 270 degrees, or any other suitable angles.

Figure 9:
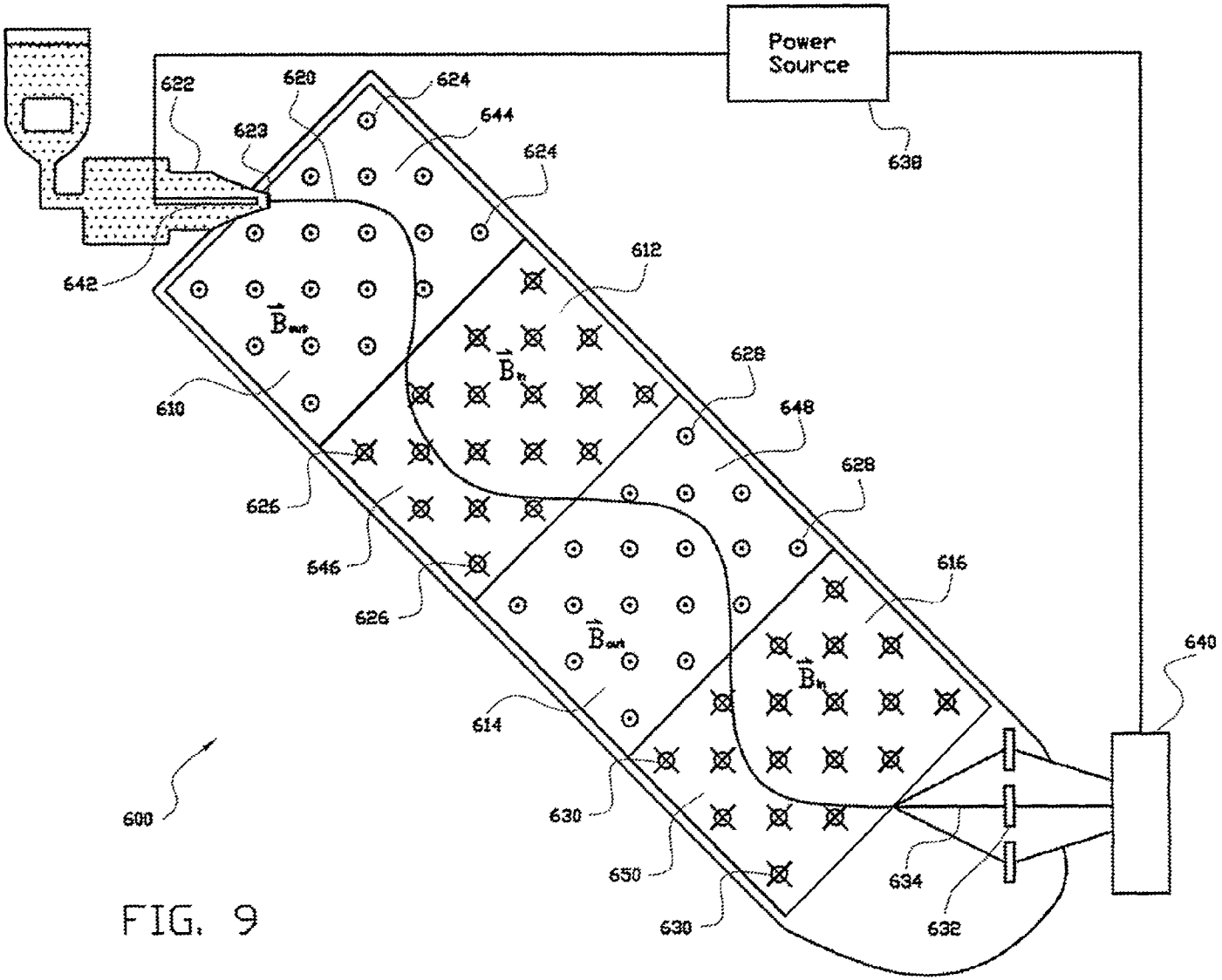
FIG. 9 is a schematic representation of an alternate embodiment of an electrospinning apparatus, having alternate magnetic bending control of a jet of the electrospinning apparatus.

FIG. 9 shows an alternate embodiment of the present invention, an electrospinning apparatus 600, is similar to the electrospinning apparatus 500, i.e., the electrospinning apparatus 600 has a plurality of magnets 610, 612, 614, and 616, which bend jet 620 repeatedly. The jet 620 is discharged from jet supply device 622, which has orifice 623, and travels through flux lines 624, 626, 628, and 630 generated by the magnets 610, 612, 614, and 616, respectively. The electrospinning apparatus 600 has collector 632 for collecting polymer fibers 634, power source 638 in electrical communication with and supplying power to voltage controller 640, which is in electrical communication with and supplying power to the collector 632 and electrode 642 of the jet supply device 622. The jet 620 is drawn from orifice 623 of the jet supply device 622 through bending zones 644, 646, 648, and 650 to the collector 632, the bending zones 644, 646, 648, and 650 being similar to that of the bending zone 537 of the electrospinning apparatus 500, except that the angles of the bending zones 644, 646, 648, and 650 are each selected to be approximately 90 or 270 degrees. The electrospinning apparatus 600 uses magnetic focusing. The dispersion of the jet 620 is controlled by controlling the magnetic flux lines developed by the magnets 610, 612, 614, and 616 in the bending zones 644, 646, 648, and 650, respectively.

Although the present invention has been described in considerable detail with reference to certain preferred versions thereof, other versions are possible. Therefore, the spirit and scope of the appended claims should not be limited to the description of the preferred versions contained herein.

What is claimed is:

1. A method for spinning a polymer fiber from a fluid comprising a polymer in the presence of an electric field established between a plurality of collectors and a jet supply device, comprising:

a) forming an electrospinning jet stream of said fluid directed toward said plurality of collectors;

b) controlling dispersion characteristics of said fluid by applying a magnetic field created by at least one magnet located after the point of jet formation;

c) forming at least one polymer fiber on at least one collector of said plurality of collectors.

2. The method of claim 1, wherein said controlling said dispersion characteristics of said fluid further comprises:

a) applying different voltages to at least two collectors of said plurality of collectors;

b) controlling said applied voltages.

3. The method of claim 1, wherein:

said at least one polymer fiber comprises at least two polymer fibers.

4. The method of claim 1, wherein said at least one collector of said plurality of collectors comprises at least two collectors of said plurality of collectors and said at least one polymer fiber comprises at least two polymer fibers;

said forming said at least one polymer fiber at said at least one collector of said plurality of collectors comprises forming said at least two polymer fibers at said at least two collectors of said plurality of collectors.

5. The method of claim 1, wherein b) further comprises:

controlling dispersion characteristics of said fluid by applying a magnetic field created by at least one magnet located between said jet supply device and said at least two collectors of said plurality of collectors.

6. A method for spinning a polymer fiber from a fluid comprising a polymer in the presence of an electric field established between at least one collector and a jet supply device, comprising:

a) forming an electro spinning jet stream of said fluid directed toward said at least one collector;

b) controlling dispersion characteristics of said fluid by applying a magnetic field created by at least one magnet located between said jet supply device and said at least one collector;

c) forming at least one polymer fiber at said at least one collector.

7. The method of claim 6, wherein:

said at least one polymer fiber comprises at least two polymer fibers.

8. The method of claim 6, wherein said at least one collector comprises at least two collectors and said at least one polymer fiber comprises at least two polymer fibers:

said forming said at least one polymer fiber at said at least one collector comprises forming said at least two polymer fibers at said at least two collectors.

9. The method of claim 6, wherein said at least one magnet applying said magnetic field between said jet supply device and said at least one collector comprises:

applying said magnetic field substantially transverse to said electrospinning jet stream.

10. The method of claim 6, wherein said at least one magnet applying said magnetic field between said jet supply device and said at least one collector comprises:

applying said magnetic field substantially collinear with said electrospinning jet stream.

11. The method of claim 6, wherein said at least one magnet applying said magnetic field created by at least one magnet located between said jet supply device and said at least one collector further comprises:

changing direction of travel of said electrospinning jet stream of said fluid.

12. The method of claim 6, wherein said at least one magnet applying said magnetic field created by at least one magnet located between said jet supply device and said at least one collector further comprises:

changing direction of travel of said electrospinning jet stream of said fluid at least twice.

13. The method of claim 6, wherein said at least one magnet applying said magnetic field created by at least one magnet located between said jet supply device and said at least one collector further comprises:

changing direction of travel of said electrospinning jet stream of said fluid so as to have curvilinear motion.

14. The method of claim 6, wherein said at least one magnet applying said magnetic field created by at least one magnet located between said jet supply device and said at least one collector further comprises:

changing the path of said electrospinning jet stream of said fluid by bending said path of said electrospinning jet stream of said fluid.

15. The method of claim 14, wherein said bending comprises changing direction of travel of said electrospinning jet stream of said fluid.

16. The method of claim 14, wherein said bending comprises changing direction of travel of said electrospinning jet stream of said fluid at least twice.

17. The method of claim 14, wherein said bending comprises:

changing direction of travel of said electrospinning jet stream of said fluid so as to have curvilinear motion.

18. The method of claim 1 or claim 6, wherein:

said at least one magnet comprises at least two magnets.

19. The method of claim 1 or claim 6, wherein:

said at least one magnet is located in the vicinity of said electrospinning jet stream.

20. The method of claim 1 or claim 6, wherein:

said at least one magnet comprises at least one electromagnet.

21. The method of claim 20, wherein:

said method further comprises a controller for controlling the value of said magnetic field of said at least one magnet.

22. The method of claim 1 or claim 6, wherein:

said method further comprises a controller for controlling the direction of said magnetic field of said at least one magnet.

* * * * *